US005718658A

United States Patent [19]

Miller et al.

[11] Patent Number: 5,718,658

[45] Date of Patent: Feb. 17, 1998

[54] SKATE TRAINING EXERCISE APPARATUS AND METHOD

[75] Inventors: Kenneth Miller, New York; Edward Trainor, Brentwood, both of N.Y.

[73] Assignee: Town Sports International Inc., New York, N.Y.

[21] Appl. No.: 256,722

[22] PCT Filed: Jan. 28, 1994

[86] PCT No.: PCT/US94/01026

§ 371 Date: Jan. 11, 1994

§ 102(e) Date: Jan. 11, 1994

[87] PCT Pub. No.: WO94/16776

PCT Pub. Date: Aug. 4, 1994

Related U.S. Application Data

[62] Division of Ser. No. 10,925, Jan. 29, 1993, Pat. No. 5,284, 460.

[51] Int. Cl.[6] ..... A63B 69/18

[52] U.S. Cl. ..... 482/71; 482/51

[58] Field of Search ..... 482/51, 71, 79, 482/145, 146; 601/34, 35; 422/70

[56] References Cited

U.S. PATENT DOCUMENTS 4,744,557 5/1988 Smirmaul ..... 482/71
4,869,496 9/1989 Colombo ..... 482/71

FOREIGN PATENT DOCUMENTS 0673092 2/1990 Switzerland ..... 482/71

*Primary Examiner*—Lynne A. Reichard
*Attorney, Agent, or Firm*—Pennie & Edmonds LLP

[57] ABSTRACT

Apparatus and method for skate training exercise comprising arms of relatively long length pivotably mounted on a frame. The user's foot is secured in a stirrup on the arm opposite the pivot point. A resistance means is provided to provide resistance as the user pushes his foot away from the body along an arcuate path defined by the arm in simulated skating stroke. A return means is provided to assist the user in returning his foot along the arcuate path after predetermined angle is traversed. Various resistant means include electro-magnetic, fly wheel-fan and weight stack.

18 Claims, 9 Drawing Sheets

SKATE TRAINING EXERCISE APPARATUS AND METHOD

This application is a division of U.S. application Ser. No. 08/010,925, filed Jan. 29, 1993, now U.S. Pat. No. 5,284,460

BACKGROUND OF THE INVENTION

The present invention relates to exercise devices and more particularly, an exercise device for simulating skating and strengthening muscles used therein. The invention also relates to a method for exercising muscles used in skating.

With the increasing popularity of skating, particularly in-line roller skating, there has become an increased demand for exercise apparatus and methods which would allow the user to more closely simulate skating action and exercise and strengthen muscles used in skating. There is also a need for a device which provides a cardiovascular or aerobic exercise while allowing a person to train for skating.

There are a number of prior art devices which attempt with varying degrees of success to simulate a skating motion while allowing the user to exert force and exercise and strengthen muscles. For example, U.S. Pat. No. 4,340,214 to Schützer discloses a training apparatus for skaters. The Sch ützer apparatus is similar to the slideboard which is well known among serious skaters. The Schützer device provides a lateral, inclined track which allows side-to-side motion and stretching of feet and legs. An upright at the center of the device helps to maintain the user's body in the correct position.

U.S. Pat. No. 4,781,372 to McCormick and U.S. Pat. No. 4,811,941 to Elo, both disclose skating exercise devices which utilize a foot stirrup that moves along a linear track and is resisted by a weight stack. The track and stirrup are arranged to allow the user to be generally in a squatting position which attempts to simulate the skater's position. The track in each device is pivotable about a point in front of the user. The McCormick device appears to allow adjustment for pushing at different angles. The track of the Elo device also pivots in an attempt to simulate skating motion.

U.S. Pat. No. 4,915,373 to Walker discloses a further exercising machine for ice skating. The Walker device includes a bicycle-type saddle in the center, on which the user is seated in a crouching position. Foot stirrups ride in two triangular tracks on either side of the saddle, intended to approximate skating motion. A portion of each track is designated as a power section and is provided with means for creating drag on the stirrup as it passes therethrough, in order to require greater exertion of force by the user over that portion.

A further device, known as The Skating Machine™ by Sport Specific Inc. includes articulated arms with foot stirrups that pivot at two points in front of the user. Resistance is provided by adjustable fluid cylinders.

None of the devices discussed above closely simulates a natural and dynamic skating motion. Thus, in spite of the many different devices in the prior art, there is a need for an exercise apparatus which will allow close simulation of a natural and dynamic skating motion at both relatively high and low speeds while allowing strengthening or aerobic exercise. This need has not yet to date been met by the art.

SUMMARY OF THE INVENTION

It is therefore an object of the present invention to provide an apparatus and method for skate training exercise which closely simulates the natural and dynamic motion of a skater.

This and other objects are achieved according to the present invention by an apparatus for skate training exercise, comprising a frame with at least one arm having a first end pivotably mounted on the frame and a second end capable of movement between a first position and a second position along an arc defined by the arm. Mounted on the second end of the arm are means for securing the foot of a user, wherein said means is configured and dimensioned such that the user is positioned with the pivot point disposed behind the user. The apparatus also includes means for resisting movement of the arm from the first position to the second position and may further include means for returning the arm from the second position to the first position. In a preferred embodiment, the apparatus has first and second arms, wherein the arms are disposed adjacent to each other with their respective pivot points disposed along a common line. The common line is at least approximately perpendicular to both arms when the arms are parallel to a line defining a direction of simulated forward travel. Each arm preferably pivots through a total angle of about 120°. Preferably about 60° of the total angle of travel is toward the other arm and beyond a line passing through its respective pivot and parallel to the forward travel line.

The apparatus according to the invention may further comprise flexible element means for linking the arms with said resisting and returning means. Resistance means such as electro-magnetic resistance or fly wheel resistance mechanisms may be employed. The flexible element means may include chains, cables or other suitable elements.

In the method for skate training exercise according to the invention, the following steps are included: Guiding a user's first foot along an arcuate path having a center point disposed behind the user. Preferably, the arcuate path has a radius at least about the length of the user's leg. Resisting force applied by the user along the arcuate path in a direction away from the user's body. Stopping movement along the arcuate path at a predetermined position. A further step may involve assisting the user in returning his/her foot to the first position along the arcuate path. The steps may be repeated alternately between the user's first foot and second foot.

DETAILED DESCRIPTION OF THE PREFERRED EMBODIMENTS

Figure 1:
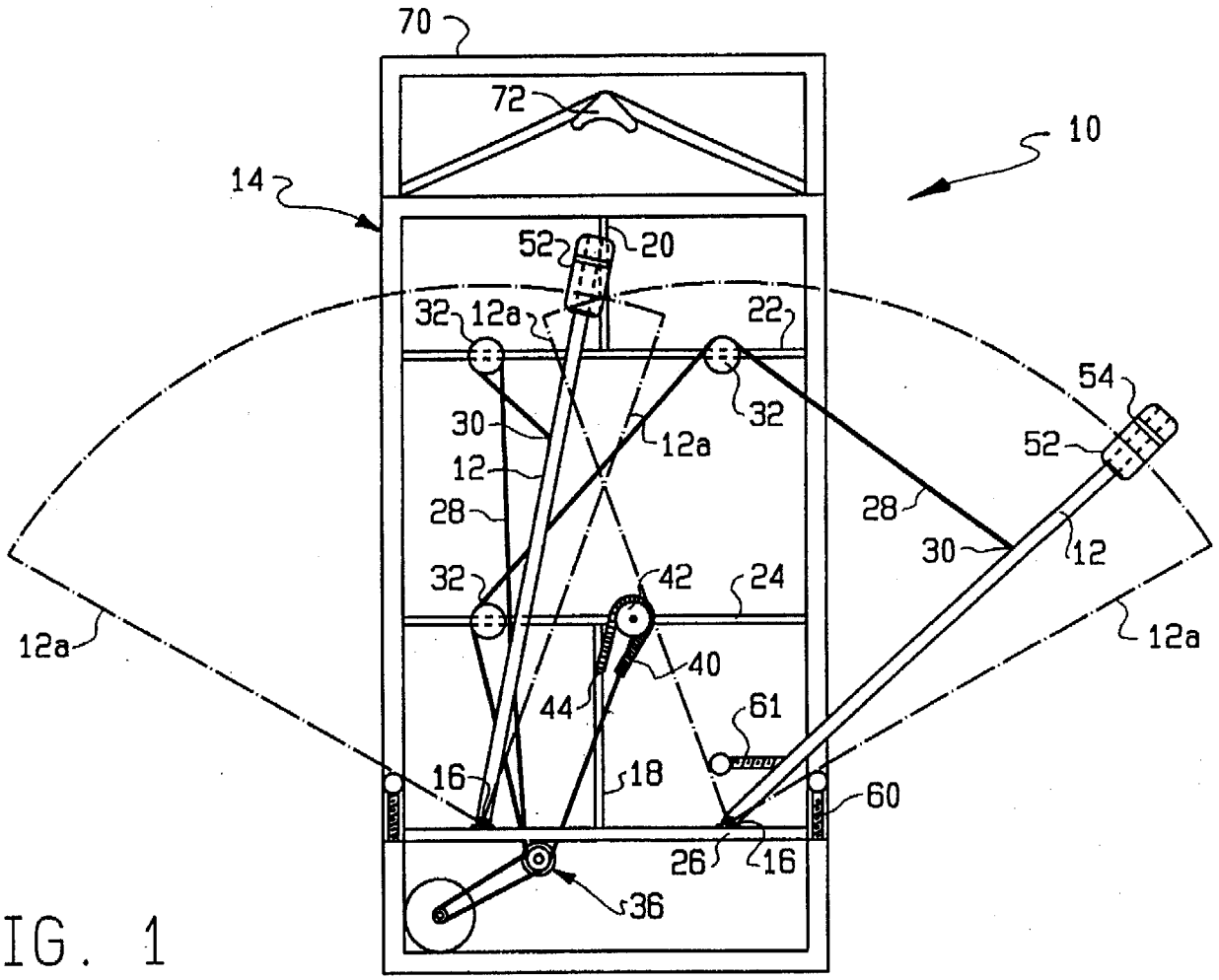
FIG. 1 is a plane view of a first embodiment of the skate training apparatus according to the present invention.
Figure 2A:
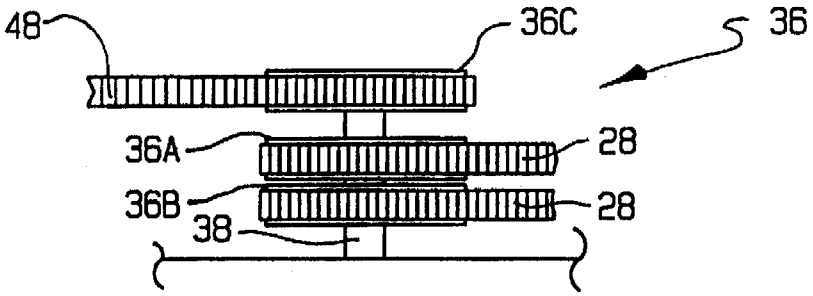
FIG. 2A is a partial, enlarged side view of the sprocket assembly shown in FIGS. 1 and 2.
Figure 2:
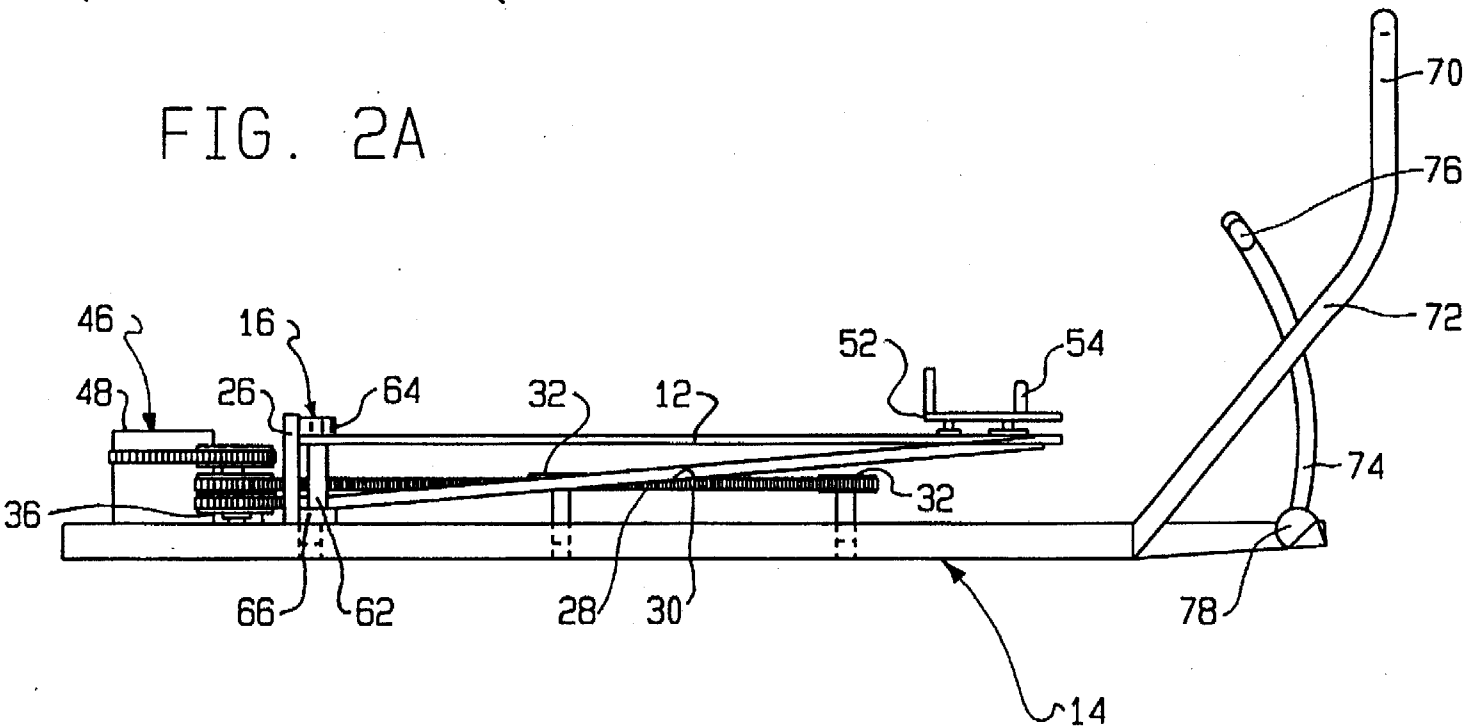
FIG. 2 is a side view of the apparatus shown in FIG. 1.
Figure 3:
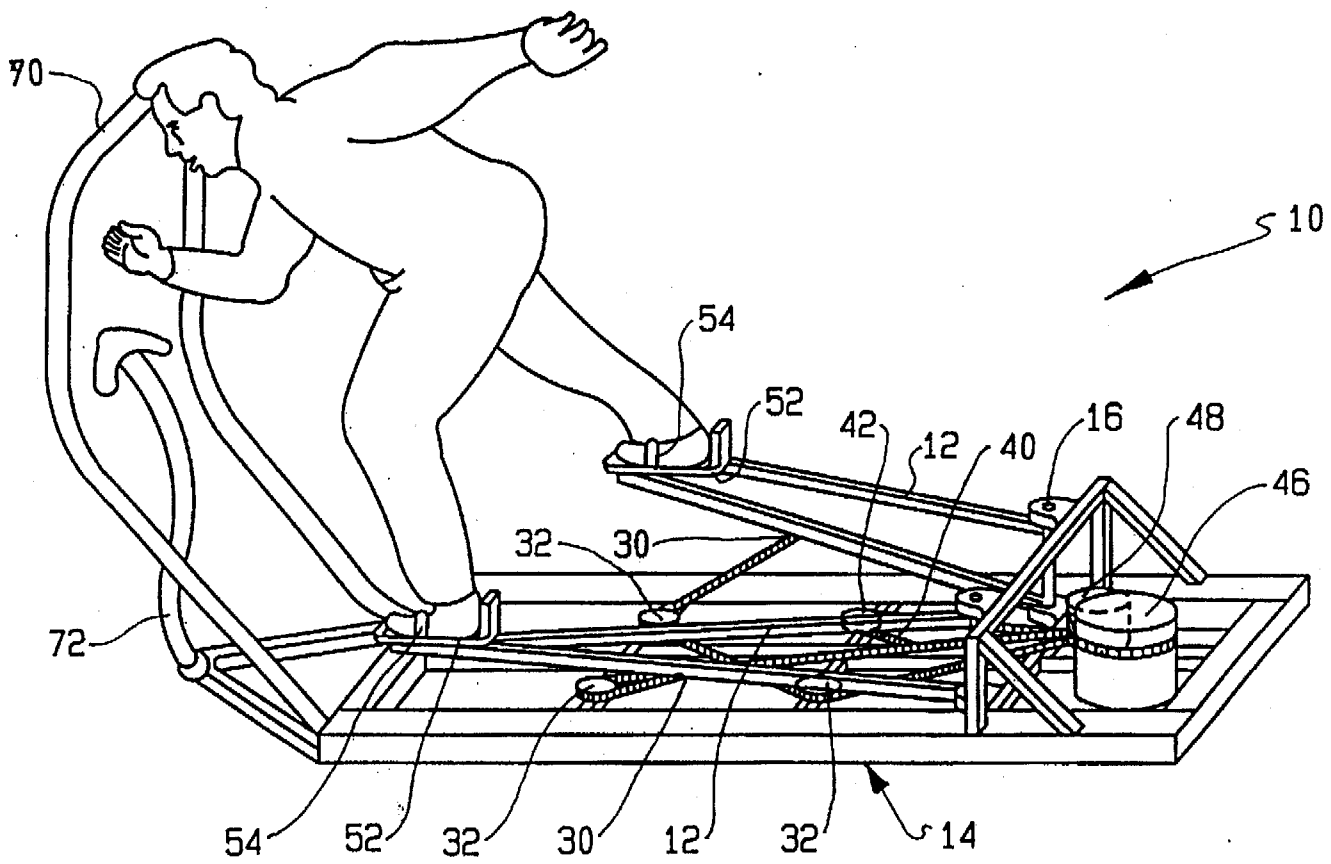
FIG. 3 is a perspective view of a person using an apparatus of FIG. 1 to simulate skating.

FIGS. 1, 2 and 3 illustrate a basic arrangement for the skate training exercise apparatus 10 according to the present invention. Skating arms 12 are pivotably mounted on frame 14 at pivots 16. Frame 14 includes internal frame members 18, 20, 22, 24 and 26 to provide structural stiffness and support pulleys or sprockets as described below. Flexible elements 28, such as cables or chains are secured at 30 to skating arms 12. By way of example, in the embodiment described herein, flexible element 28 is a bicycle-type chain cooperating with sprockets 32. Other arrangements, for example using cables and pulleys also may be used and are discussed below. The components of the present invention are constructed of commercially available materials, the selection of which is within the ability of the ordinary skilled worker.

Chains 28 are wound around sprockets 32 mounted on frame 14. The chain and sprockets associated with one of the skating arms are disposed above the other chain and sprockets to prevent interference therebetween. Chains 28 come together at resistance sprocket assembly 36 which includes side-by-side ratcheted sprockets 36A and 36B mounted one above the other on a single shaft 38 (FIG. 2A). Both cables then continue in a parallel arrangement to connect with return springs 40. Return springs 40 traverse around dual pulley 42 and are secured at 44 to frame member 18.

Skating arms 12 are provided, at the end opposite pivots 16, with foot stirrups 52 having straps 54 to secure the user's foot therein. Once the user has strapped his feet into the stirrups, he or she pushes out and to the side, simulating a skating stroke. Skating arms 12 pivot about pivot points 16 causing chain 28 to travel therewith and around sprockets 32. As chain 28 extends with the arm, it causes resistance sprocket assembly 36 to rotate. Sprockets 36A and 36B are ratcheted on shaft 38 such that rotation of either in the forward direction (counterclockwise in FIG. 1) causes rotation of sprocket 36C, also in the forward direction. The ratchet allows each sprocket 36A or B to reverse direction as its associated skating arm returns to center, without reversing sprocket 36C. An appropriate resistance means cooperates with sprocket 36C to provide the desired resistance for the user.

In the embodiment shown in FIGS. 1 and 2, resistance is provided by an electro-magnetic resistance mechanism 46, which is known in the art. A resistance chain 48 traverses around sprocket 36C which is mounted concentrically with sprockets 36A and 36B. Chain 48 runs around the associated sprocket of resistance mechanism 46, the operation of which is understood by persons skilled in the art.

Stops 60 can be provided on frame 14 to control the outward angle of travel of skating arm 12. The stop position may be adjustable, such as by a screw as shown. Once the skating arm has reached limit of travel and the user releases force applied thereto, spring 40, which was extended by the outward travel of skating arm 12, causes the return of skating arm by acting through chain 28. Inside stops 61, mounted on arms 12, control the degree of inward travel of arms 12 by abutting against frame member 26 (the left hand stop is omitted from the drawings for clarity). Preferably, the total angle of travel of a skating arm is at least about 60°, with about five to fifteen degrees being to the inside of the skating arms. More preferably, the total angle of travel is about 120°, with approximately 60° to the inside. As shown in FIG. 1, stops 60 and 61 are adjusted to allow about 80° total travel, 60° to the outside and 20° to the inside. The extent of travel is indicated by arms 12*a*, shown in phantom lines. Ideally the extent of travel is adjusted such that during regular skating motion the stops are not contacted. Instead, the outward motion of an arm is stopped by a combination of increasing resistance from the resistance means and the user's weight shift at the end of a stroke.

The superior dynamic skating motion achievable with the present invention is due, at least in part, to the arrangement of skating arms 12 and location of pivots 16 with respect to the user. By placing the user's feet at the end of the relatively long skating-arms with pivot points located behind the user, the natural skating motion is closely simulated while at the same time providing a mechanism which is relatively simple and easy to adapt for resistance. Preferably, the length of skating arms 12 from pivot 22 to stirrup pivot 56 is about the same or slightly greater than the length of the average user's leg, approximately 34–36 inches. If desired, the skating arms can be provided with an adjustable length. Other dimensions of the apparatus which have provided satisfactory results are the distance between pivot points 16 along member 26 being about fifteen inches and the distance along arms 12 from pivot 16 to connection 30 being about twenty-four inches.

Figure 8:
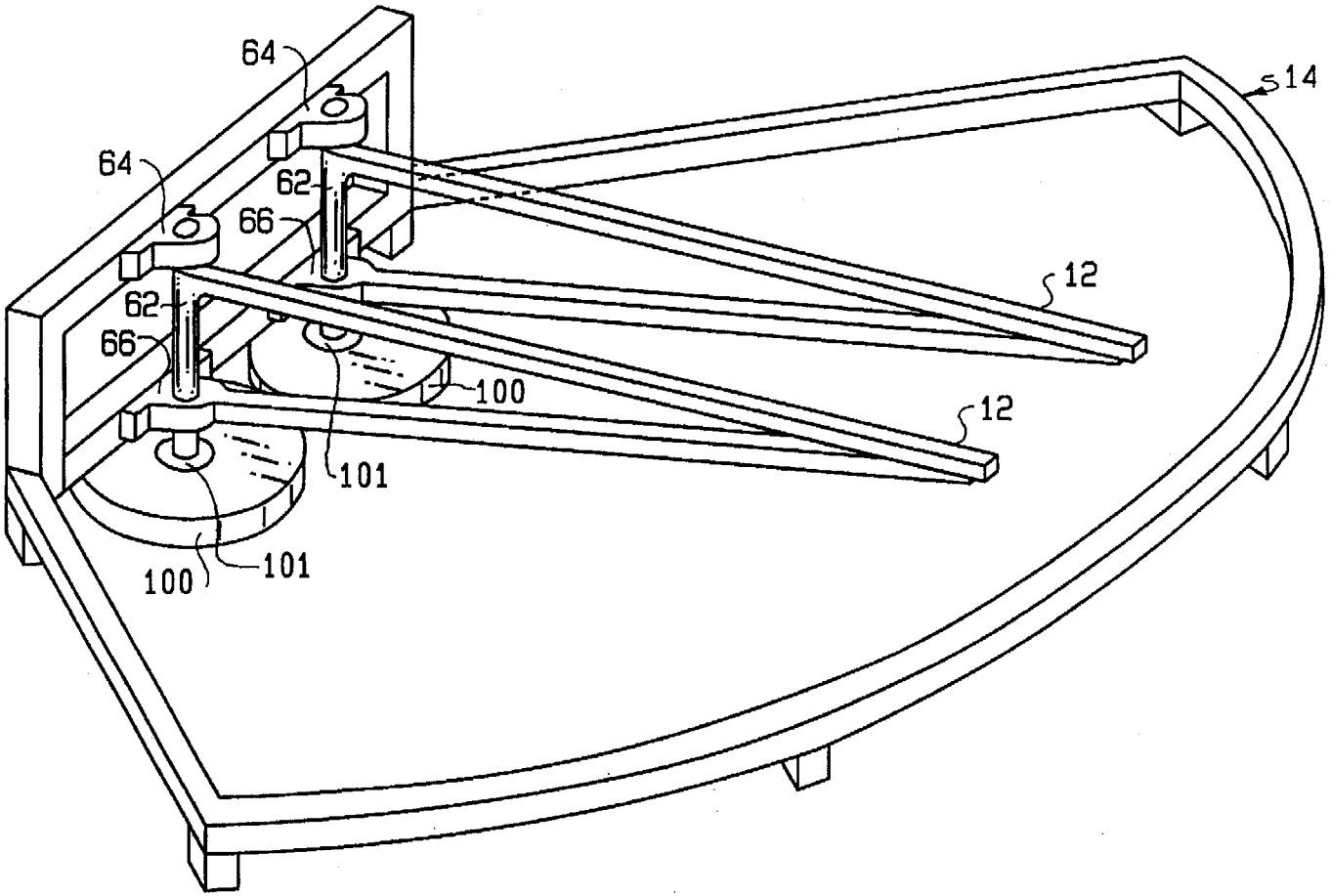
FIGS. 8 and 9 are perspective and plan views, respectively, of an alternative embodiment of the invention.
Figure 9:
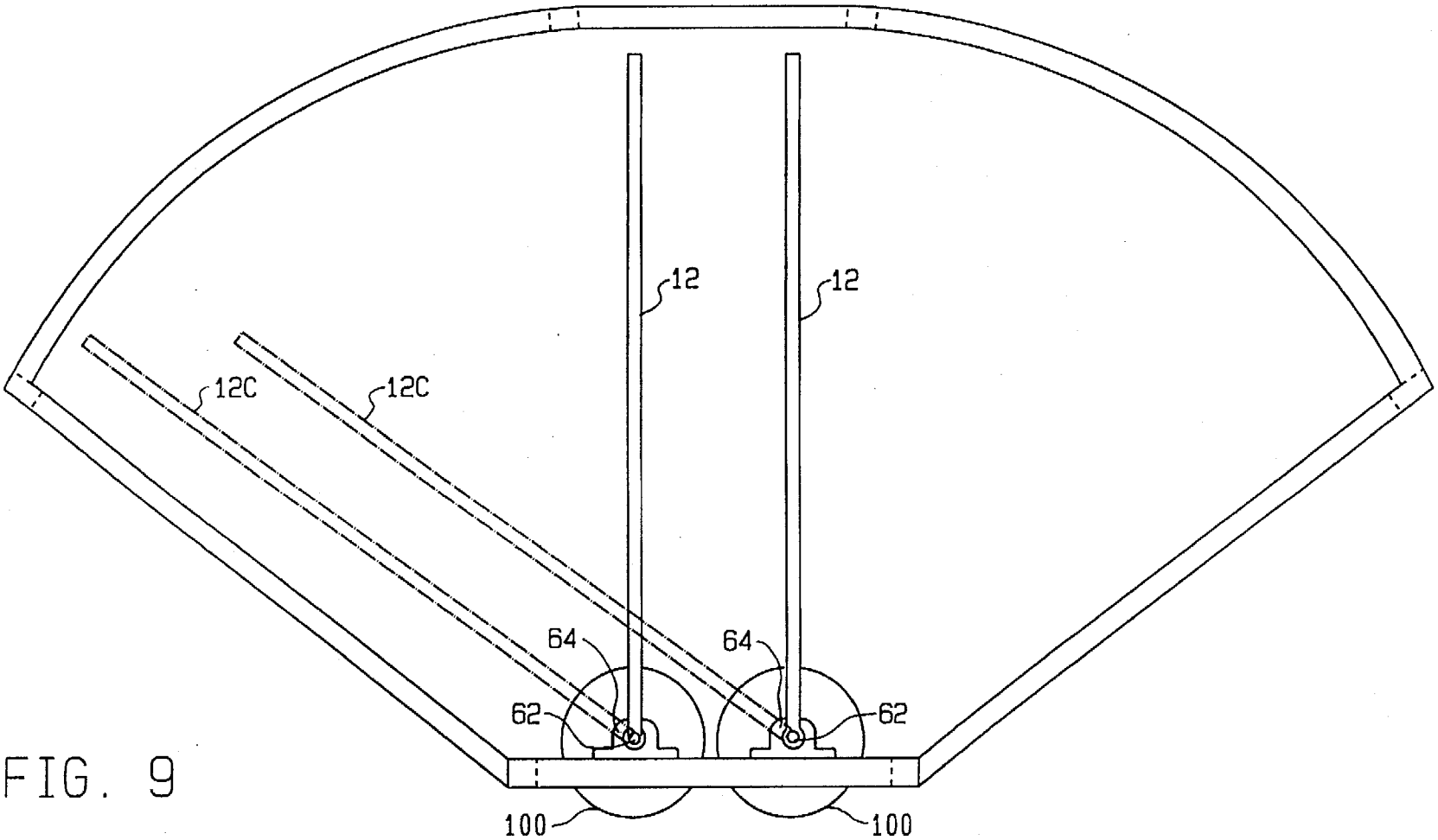

The realism of the skating motion is further enhanced by the positioning of the pivot points to allow the user's feet to "crossover" on the inward movement. As explained above, at least approximately five to fifteen degrees of the angular travel of the skating arms is to the inside; that is, towards the opposite foot from a position where the arm is perpendicular to frame member 26. Preferably, as shown in FIGS. 8 and 9, the arms may travel freely an equal amount to both sides. At the point where the arm is perpendicular to member 26, it is also parallel to an imaginary line representing the direction of simulated skating. The angular travel is to both sides of the line representing the direction of skating.

Referring to FIGS. 2 and 8, it can be seen that skating arms 12 are constructed as a truss, with upper and lower members to provide sufficient strength and rigidity. Pivots 16 comprise shafts 62 to which the upper and lower members of skating arm 12 are secured, such as by welding. Shaft 62 is carried in upper and lower bearings 64, 66 respectively. Bearings 64 and 66 are preferably pillow block bearings which provide low friction and high strength in order to continue to pivot freely without binding under the loads exerted in supporting the cantilevered skating arms.

Stationery grip 70 is provided to allow the user to steady himself when getting on and off the apparatus and also to provide security for new users. Moving support 72 provides support for more experienced users during skating motion and allows the user to support the upper body without detracting from the natural skating motion. Support 72 comprises shaft 74 with curved handle 76 at the upper end. At the opposite end, shaft 74 is secured to frame 14 by a ball joint 78 to allow free side-to-side motion.

Figure 4:
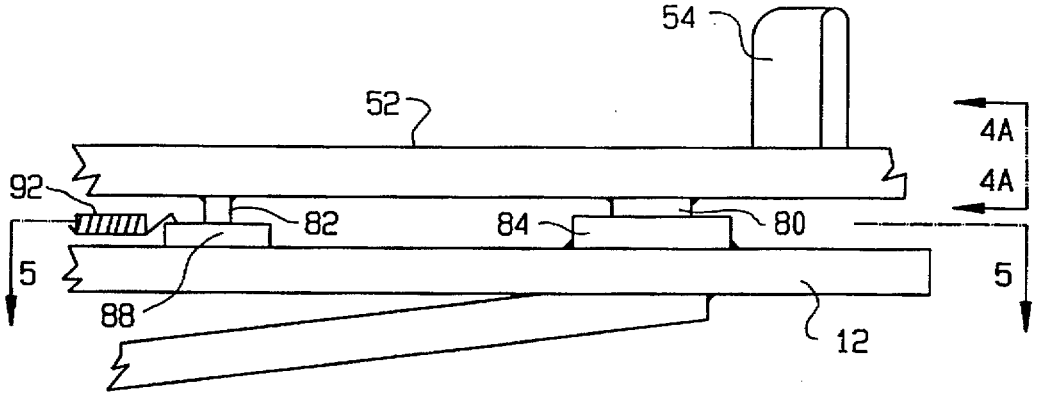
FIG. 4 is a side view of an embodiment of a foot stirrup according to the invention.
Figure 5:
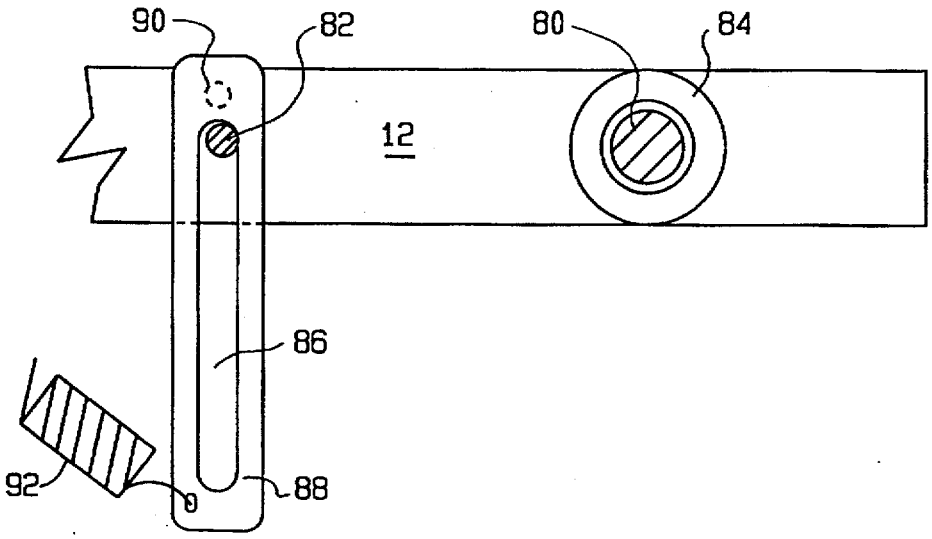
FIG. 5 is a cross-sectional view through line 5—5 of FIG. 4.

As shown in FIGS. 1 and 2, stirrups 52 are secured directly to arms 12. However, preferably, be stirrups 52 are permitted to rotate with respect to arms 12. Rotation may be through a limited angle or 360°. A useful means for limiting and controlling the rotation of the stirrups is illustrated in FIGS. 4 and 5. As shown therein, stirrup 52 is mounted on shaft 80 and also has pin 82 extending downward therefrom. Shaft 80 is received in bearing 84, mounted on arm 12. Bearing 84 is preferably a roller bearing to reduce friction to the greatest extent possible. A person of ordinary skill in the art can select a suitable bearing. Pin 82 is received in slot 86 of control arm 88. Control arm 88 is pivotably mounted on skating arm 12 at pivot 90. The motion of control arm 88 is restrained by extension spring 92, which is secured between the control arm and skating arm 12.

Figure 4A:
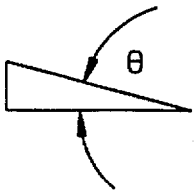
FIG. 4A is a schematic cross-sectional view through line 4A—4A of FIG. 4.

In a further alternative, stirrup 52 is canted at an angle θ of between about 5°–15°, as shown in FIG. 4A. The angle is such that the high side of the stirrup is to the outside. Preferably angle θ is about 10°.

With the arrangement described above, as the user's foot moves outward during the skating motion, the stirrup pivots to maintain the foot essentially parallel to the imaginary direction of travel, just as it would during actual skating. As the stirrup pivots around shaft 80, pin 82 rotates outward with respect to arm 12, but is restrained by control arm 88 and spring 92. The user's feet thus follow the natural skating motion while not pivoting freely so as to feel uncontrolled.

Figure 6:
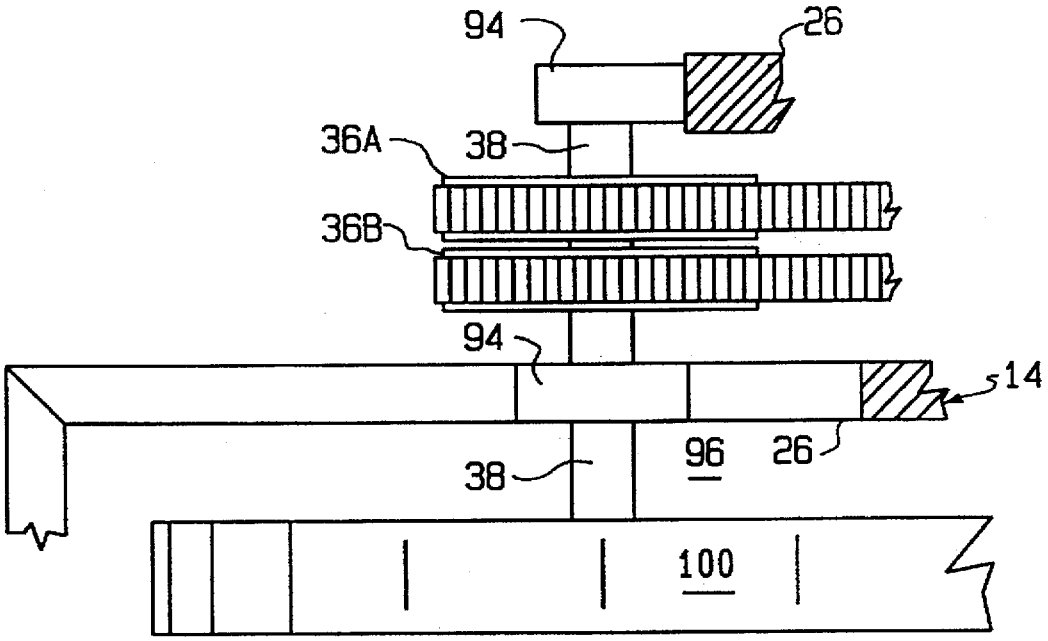
FIG. 6 is a partial side view of a fly wheel-fan resistance mechanism according to an alternative embodiment of the invention.

Persons of ordinary skill in the art will appreciate that resistance means other than electro-magnetic as described above may be readily adapted to the present invention. For example, shown in FIG. 6 is a fly wheel-fan resistance mechanism for use in an alternative embodiment of the present invention. Fly wheel-fan mechanisms are known to one of ordinary skill in the art. Ratchet sprockets 36A and 36B are arranged on shaft 38, as previously described. However, instead of resistance sprocket 36C at the top, shaft 38 is supported by an additional bearing 94. Shaft 38 extends downward, below frame member 26, into a space 96 defined by frame 14. Fly wheel-fan 100 is mounted on shaft 38 in the space provided. The back-and-forth motion of the arms, acting through chains 28 and ratcheted sprockets 36A and 36B, causes shaft 38 to rotate the fly wheel-fan and create resistance to the user's motion. A plain fly wheel or friction resistance with or without a fly wheel also may be used.

Figure 7:
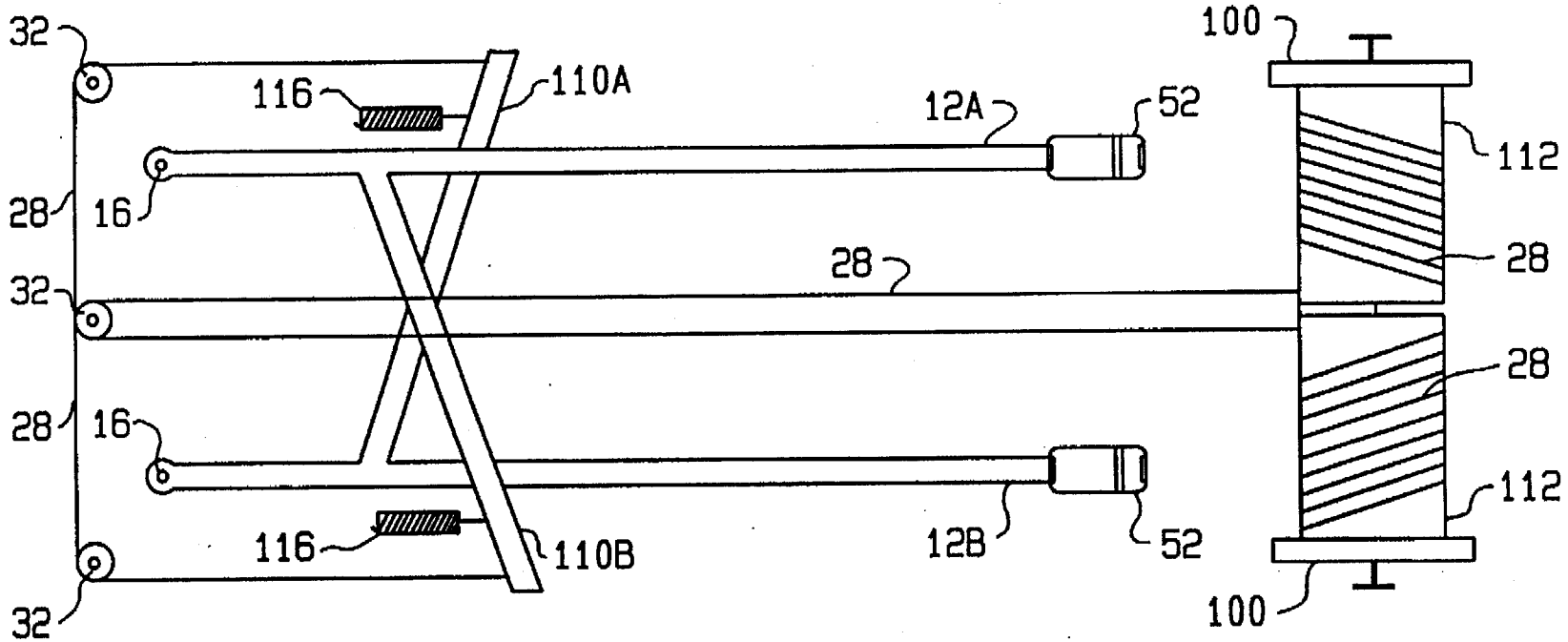
FIG. 7 is a schematic plan view of a further alternative embodiment of the invention.

A further alternative embodiment of the present invention is illustrated schematically in FIG. 7. In this embodiment, skating arms 12A and B are provided with laterally extending power arms 110A and B, respectively, mounted one above the other to avoid interfering with each other. Cables 28 are secured to the ends of power arms 110 and are guided around pulleys 32 to drums 112. Cables 28 are wrapped around the drums so that the outward motion of arms 12 causes the cable to unwrap and rotate the drums. Drums 112 are ratchet mounted on shafts in the same manner that ratchet sprockets 36A and 36B are mounted on shaft 38. The drums drive the shaft, which in turn drives resistance means such as fly wheel-fans 100.

Separate fly wheel-fans 100 are shown for each drum in the embodiment of FIG. 7; however, the drums may cooperate through a common shaft to utilize a single fly wheel-fan. Other resistance means as described herein are also contemplated. Drums 112 are provided with torsion springs to rewrap the cable during the return swing of arms 12. Additional, optional springs, such as extension springs 116, can be provided for greater resistance and faster return.

A further alternative embodiment is illustrated in FIGS. 8 and 9. This embodiment is shown without foot stirrups or grips, which may be provided as previously described. Skating arms 12 are again mounted on shafts 62, carried by pillow block bearings 64 and 66. However, the shafts extend below the lower bearing with a separate fly wheel-fan resistance mechanism 100 mounted on each. In order to provide resistance in only the outward stoke direction, each flywheel-fan is mounted on shaft 62 with internal ratchet 101. The use of individual fly wheels, directly mounted on shafts 62 eliminates the need for a cable and pulley system.

As also shown in FIGS. 8 and 9, frame 14 can be configured to occupy the entire area which will be required for operation of the device. Although not necessarily required for stability, this larger foot print increases safety because it prevents other equipment or objects from being placed too close to the skating device when it is not in use. FIG. 9 also clearly illustrates the capability of the skating arms to move freely in both directions as desired (in phantom lines at 12*c*). With advanced and well conditioned skaters positive stops and positive return means are not required. The skater's natural outward push against the resistance will create a natural stop, against which the next stroke is made. Return of the skating arms occurs automatically with the next successive stroke. The crossover of the trailing skating arm as previously described will occur naturally to correspond to the degree of crossover the user applies in actual skating.

Figure 10:
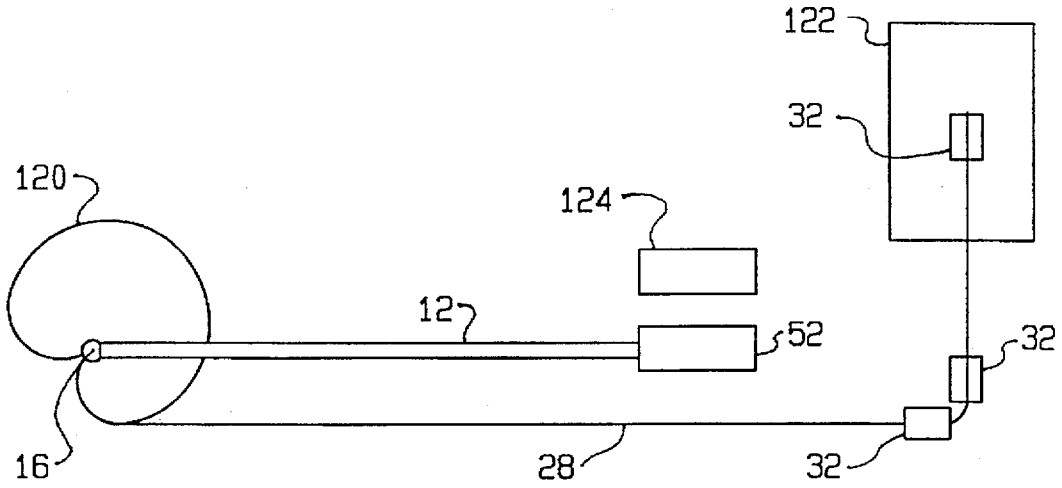
FIGS. 10 and 11 are schematic plan and front views, respectively, of a further alternative embodiment of the invention employing weight stack resistance.
Figure 11:
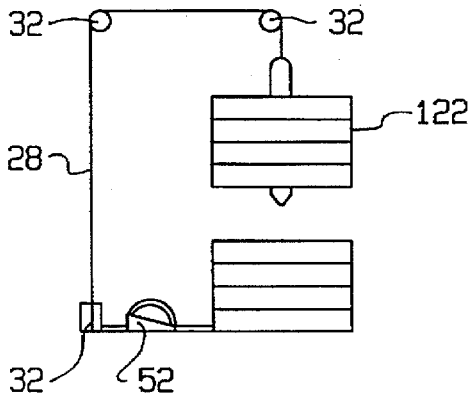

One or more weight stacks also may be used for resistance. Weight stacks are particularly useful for strength training machines. FIGS. 10 and 11 schematically illustrate a strength training device according to the present invention. Cable cam 120 is secured to arm 12, both of which rotate around pivot 16. Pivot 16 is again disposed behind the user during use of the invention. Cable 28 is secured to the cam at one end and traverses around pulleys 32 to weight stack 122. Both cam 120 and weight stack 122 are conventional and well understood by persons skilled in the design of exercise machines. The user selects the amount of weight desired and places his or her foot in stirrup 52. Resistance footpad 124 is provided for the user to push against. Preferably, in order to allow exercise of both legs, a second skating arm, cam and weight stack can be arranged in mirror image configuration adjacent to the first. In this case resistance foot pad 124 is replaced by the stirrup of the opposite skating arm. Suitable locking means to secure one skating arm while the other is extended can be provided by a person of ordinary skill in the art.

What is claimed:

1. An apparatus for skate training exercise, comprising:

a frame;

first and second arms, each having a first end pivotably mounted on the frame and a second end capable of movement between a first position and a second position along an arc defined by each said arm, said arms being disposed adjacent to each other with their respective pivots along a common line approximately perpendicular to both said arms when the arms are parallel to a line defining a direction of simulated forward travel, wherein each said arm pivots at least about 5°–15° toward the other arm and beyond a line passing through its respective pivot and parallel to the forward travel line;

means for securing the foot of a user to the arm adjacent the second end, wherein said means is configured and dimensioned to position a user with said pivot disposed behind the user; and means for resisting movement of the arm from said first position to said second position.

2. The apparatus according to claim 1, further comprising means for returning the arm from the second position to the first position.

3. The apparatus according to claim 1, wherein each said arm pivots through an angle of between about 60°–120°.

4. The apparatus according to claim 1, wherein said foot securing means is rotatable with respect to the arm.

5. The apparatus according to claim 4, wherein said foot securing means comprises means for canting the user's foot at an angle between about 5°–15°

6. The apparatus according to claim 4, wherein said foot securing means includes means for limiting rotation to a predetermined angle.

7. The apparatus according to claim 6, wherein said limiting means includes spring biased means for returning said foot securing means to a first orientation.

8. The apparatus according to claim 2, further comprising flexible element means for linking said at least one arm with said resisting means and returning means.

9. The apparatus according to claim 8, wherein said resisting means comprises an electro-magnetic resistance mechanism.

10. The apparatus according to claim 8, wherein said resistance means comprises a fly wheel resisting mechanism.

11. The apparatus according to claim 8, further comprising ratchet means for rotating said resisting means wherein said flexible element means cooperates with said ratchet means to rotate said resisting means when said arm moves from the first position to the second position and to allow free movement in an opposite direction when said arm returns to the first position.

12. The apparatus according to claim 11, wherein said returning means comprises spring means for cooperating with said flexible element means.

13. The apparatus according to claim 12, wherein said spring means comprises an extension spring secured to said flexible element means at one end and to the frame at the opposite end.

14. The apparatus according to claim 12, wherein said return means comprises a drum mounted on said ratchet means with said flexible element means wrapped at least partially around the drum; and wherein said spring means comprises a torsion spring cooperating with the drum to rotate the drum and tending to wrap said flexible element means therearound.

15. The apparatus according to claim 1, further comprising movable means for supporting the user's upper body during exercise.

16. The apparatus according to claim 15, wherein said supporting means comprises a shaft member extending upwardly from the frame and secured to the frame by a joint allowing at least side-to-side motion of the shaft.

17. The apparatus according to claim 1, wherein said first and second arms are supported only at the first end by said frame and are pivotably mounted to permit free pivoting movement from the second position to the first position.

18. An apparatus for skate training exercise, comprising:

a frame;

first and second arms, each having a first end pivotably mounted on the frame and a second end capable of movement between a first position and a second position along an arc defined by each said arm, said arms being disposed adjacent to each other with their respective pivots along a common line approximately perpendicular to both said arms when the arms are parallel to a line defining a direction of simulated forward travel;

means for securing the foot of a user to the arm adjacent the second end, wherein said means is configured and dimensioned to position a user with said pivot disposed behind the user; and means for resisting movement of the arm from said first position to said second position;

Wherein each said arm is secured to a substantially vertical shaft and said shaft is mounted on the frame and rotatable with respect thereto; and said resisting means comprises a fly wheel mechanism mounted on each shaft and including ratchet means such that each flywheel mechanism resists rotation of its respective shaft in one direction only.

* * * * *

UNITED STATES PATENT AND TRADEMARK OFFICE

CERTIFICATE OF CORRECTION

PATENT NO. : 5,718,658

DATED : February 17, 1998

INVENTOR(S) : Miller *et al.*

It is certified that error appears in the above-indentified patent and that said Letters Patent is hereby corrected as shown below:

ON THE TITLE PAGE:

Item 86, § 371 Date:, "Jan. 11, 1994" should read --November 1, 1994--.

Item 86, § 102(e) Date:, "Jan. 11, 1994" should read --November 1, 1994--.

Signed and Sealed this

Twenty-ninth Day of September, 1998

*Attest:*

*Attesting Officer*

BRUCE LEHMAN

*Commissioner of Patents and Trademarks*